US007391149B2

(12) United States Patent
Yamazaki

(10) Patent No.: US 7,391,149 B2
(45) Date of Patent: Jun. 24, 2008

(54) IMAGE DISPLAY APPARATUS PROVIDED WITH HIGH RESISTIVE SPACER ELEMENT

(75) Inventor: Koji Yamazaki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 11/165,360

(22) Filed: Jun. 24, 2005

(65) Prior Publication Data

US 2006/0001345 A1 Jan. 5, 2006

(30) Foreign Application Priority Data

Jun. 30, 2004 (JP) ..... 2004-193480

(51) Int. Cl.
*H01J 1/62* (2006.01)
*H01J 63/04* (2006.01)

(52) U.S. Cl. ..... 313/495; 313/496; 313/292

(58) Field of Classification Search ..... 313/495–497, 313/292, 309–311; 315/169.1–169.4
See application file for complete search history.

(56) References Cited

U.S. PATENT DOCUMENTS

| | | | | |
|---|---|---|---|---|
| 6,486,610 | B2 * | 11/2002 | Kojima et al. | 315/169.3 |
| 6,509,691 | B2 | 1/2003 | Yamazaki et al. | 315/169.3 |
| 6,800,995 | B2 * | 10/2004 | Ohnishi | 313/495 |
| 6,803,717 | B2 | 10/2004 | Ohnishi | 313/495 |
| 6,853,148 | B2 * | 2/2005 | Yamazaki et al. | 315/169.3 |
| 6,998,769 | B2 * | 2/2006 | Ohnishi | 313/495 |
| 7,053,537 | B2 | 5/2006 | Hiroike et al. | 313/292 |
| 2002/0084997 | A1 | 7/2002 | Ohnishi | 345/211 |
| 2005/0276096 | A1 | 12/2005 | Hara et al. | 365/158 |
| 2006/0091781 | A1 * | 5/2006 | Haraguchi et al. | 313/495 |
| 2006/0103293 | A1 | 5/2006 | Yamazaki | 313/495 |
| 2006/0103294 | A1 | 5/2006 | Suzuki et al. | 313/496 |
| 2006/0141892 | A1 | 6/2006 | Hiroike et al. | 445/24 |

FOREIGN PATENT DOCUMENTS

| | | | |
|---|---|---|---|
| EP | 1 220 273 | A2 | 7/2002 |
| JP | 10-326583 | | 12/1998 |
| JP | 2002-237268 | | 8/2002 |
| JP | 2006236733 | A * | 9/2006 |

* cited by examiner

*Primary Examiner*—Mariceli Santiago
(74) *Attorney, Agent, or Firm*—Fitzpatrick, Cella, Harper & Scinto

(57) ABSTRACT

An image forming apparatus includes a first substrate, a potential-regulated conductive element, a second substrate having an electrode and an anode electrode connected to the electrode via a resistor, and a spacer which abuts on the conductive element, electrode and anode electrode to regulate a distance between the first and second substrates. The spacer includes a base material. A first resistor film covers a side face of the base material and is electrically connected to the conductive element, electrode and anode electrode. A second resistor film covers a portion of the spacer facing the resistor, and is electrically connected to the electrode and anode electrode. A sheet resistance value of the second resistor film is less than a sheet resistance value of the first resistor film. A resistance value of the second resistor film between the electrode and anode electrode is greater than a resistance value of the resistor.

12 Claims, 9 Drawing Sheets

IMAGE DISPLAY APPARATUS PROVIDED WITH HIGH RESISTIVE SPACER ELEMENT

BACKGROUND OF THE INVENTION

1. Field of the Invention

The present invention relates to an image display apparatus which has an atmospheric pressure resistant support structure.

2. Description of the Related Art

Among image display apparatuses using electron-emitter devices, a thin flat display apparatus has recently attracted attention as an apparatus to replace a cathode-ray tube display apparatus because of its space-saving and light-weight characteristics.

Such a flat display apparatus includes a hermetic container in which a rear plate having an electron-emitter device and a face plate having an emission member (phosphor) irradiated with an electron beam to emit light, are bonded together via a frame member. The inside of the hermetic container is held in a vacuum of about $10^{-4}$ Pa. Image display apparatuses having large surface areas require the use of a mechanism for preventing deformation or destruction of the rear and face plates caused by a pressure difference between the inside of the hermetic container and the outside thereof. Accordingly, the hermetic container in these cases includes a structure support (spacer or rib) made of glass or the like, disposed therein, to support atmospheric pressure. Thus, a distance between the rear plate having a multibeam electron source and the face plate having a phosphor film is normally maintained to be within the range of sub-millimeters or several millimeters, and the inside of the hermetic container is held in a high vacuum as described above. The spacer must not much affect an orbit of electrons flying between the rear and face plates. A cause that affects the electron orbit is a static or dynamic electric field change which results owing to the presence of the spacer by charging near the spacer. Charging of the spacer may be attributed to the emission of secondary electrons from the spacer caused by entry of some electrons emitted from an electron source or electrons reflected on the face plate into the spacer, or the sticking of ions generated as a result of ionization by electron collision.

When the spacer is positively charged, the electrons flying near the spacer are drawn to the spacer, causing a distortion of a displayed image near the spacer. The influence of the charging becomes more conspicuous as the distance between the rear and face plates becomes larger.

Generally, to curb the charging, charges on the spacer are removed by providing conductivity to a surface of the spacer and supplying some currents thereto.

Examples of such display apparatuses are disclosed in Japanese Patent Application Laid-Open Nos. 10-326583 and 2002-237268 (corresponding to European Patents EP 866491 A and EP 1220273 A, respectively). In the JP 10-326583 A, as countermeasures against an undesirable discharge between rear and face plates, a configuration is described in which an anode electrode is divided on the face plate into strips and the strips are connected to a common electrode linked to a high-voltage power supply via a resistor. Also described is a method of electrically connecting the face plate to a spacer.

For the purpose of weakening an electric field of an area (nondisplay area) in which an anode electrode is not formed, JP 2002-237268 discloses a configuration in which an anode electrode and a guard electrode regulated at a potential lower than the anode electrode are disposed on a face plate and in which a resistor film is electrically connected to the anode and guard electrodes. With this configuration, an electric field of an area between the guard electrode and a frame portion is weakened, thereby preventing an occurrence of discharge caused by a shape of a member arranged in the nondisplay area. This display apparatus also includes a spacer which has a resistor film coated on a base material, and the anode and guard electrodes are electrically interconnected.

As described above, in JP 10-326583 A and JP 2002-237268 A, in addition to the anode electrode, various electrodes may be arranged on the face plate on which the anode electrode has been disposed. Such various electrodes can include a common electrode (105) in the case of JP 10-326583 A, and a potential regulated electrode (1015) in the case of JP 2002-237268 A. On the other hand, the spacer disclosed in JP 10-326583 A and 2002-237268 A has an atmospheric pressure resistant structure, and the arrangement of the spacer over the anode electrode and other various electrodes is contemplated so that an atmospheric pressure resistant function can be implemented in various places of a vacuum panel of the display apparatus. As described in JP 10-326583 A and JP 2002-237268 A, in addition to the function as the atmospheric pressure resistant structure, the spacer is required to counter-act charge-up. For this purpose, a charging prevention film on a surface of the spacer is disclosed. However, when the spacer is arranged over the anode electrode and various electrodes as described above, the spacer plays the role of a conductive path which electrically interconnects the anode electrode and various electrodes. Therefore, there is a demand for a better design which not only forms a charging prevention film on a surface of a spacer but also gives consideration to electric behaviors arising between an anode electrode and various electrodes.

SUMMARY OF THE INVENTION

An aspect of the present invention is to overcome the above-described drawbacks by providing an image forming apparatus having an improved construction, according to the present invention. In accordance with a preferred embodiment of this invention, the apparatus comprises a first substrate having an associated potential-regulated conductive element, and a second substrate having, associated therewith, an electrode regulated at a potential higher than that of the conductive element and an anode electrode connected to the electrode via a resistor. The second substrate and the associated components are arranged to face the first substrate. A spacer abuts the conductive element, the electrode and the anode electrode to regulate a distance between the first and second substrates. The spacer includes a base material, and a first resistor film which covers at least a side face of the base material and which is electrically connected to the conductive element, the electrode and the anode electrode. The second resistor film covers at least a portion of the spacer facing the resistor, and is electrically connected to the electrode and the anode electrode. A sheet resistance value of the second resistor film is less than a sheet resistance value of the first resistor film, and a resistance value of the second resistor film between the electrode and the anode electrode is greater than a resistance value of the resistor.

According to another aspect of the present invention, an image forming apparatus is provided that includes a first substrate having an associated potential-regulated conductive element, and a second substrate having, associated therewith, an anode electrode regulated at a potential higher than that of the conductive element, and a guard electrode regulated at a potential lower than that of the anode electrode. The apparatus preferably also includes a resistor film electrically connected to the anode electrode and the guard electrode. These elements and the second substrate are arranged to face the first substrate. A spacer abuts the conductive element, the anode electrode and the guard electrode to regulate a distance between the first and second substrates. The spacer includes a base material, and a first resistor film which covers at least a side face of the base material and which is electrically connected to the conductive element, the anode electrode and the guard electrode. A second resistor film covers at least a portion of the spacer facing the resistor film, and is electrically connected to the anode electrode and the guard electrode. A sheet resistance value of the second resistor film is less than a sheet resistance value of the first resistor film.

Other features and advantages of the present invention will become apparent to those skilled in the art upon reading of the following detailed description of embodiments thereof when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of this application, illustrate embodiments of the invention and, together with the description herein, serve to explain the principles of the invention.

DETAILED DESCRIPTION OF THE EMBODIMENTS

An image forming apparatus of the present invention relates to a flat electron beam display apparatus. Especially, the invention is applied to embodiments in which the electron beam display apparatus using a field emitter-device or a surface-conduction electron-emitter device needs a high voltage, although in other embodiments other types of emitter devices may be employed.

A basic configuration of the flat electron beam display apparatus according to an embodiment of the present invention will now be described.

Figure 1:
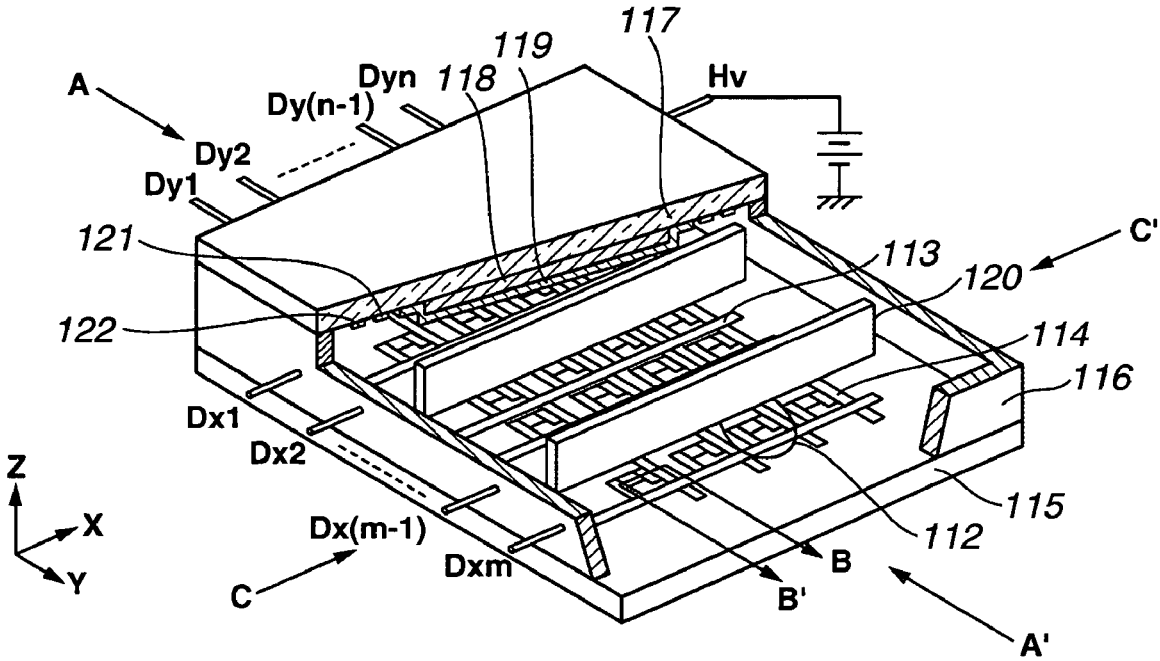
FIG. 1 is a partially cutaway perspective view of an image forming apparatus according to an embodiment of the present invention.

FIG. 1 is a partially cutaway perspective view of a display panel of the flat electron beam display apparatus, according to one embodiment of the invention to show an internal structure thereof.

Referring to FIG. 1, reference numeral 115 denotes a rear plate substrate which is a first substrate, reference numeral 116 denotes a side wall, and reference numeral 117 denotes a face plate substrate which is a second substrate. The members 115 to 117 constitute a hermetic container to maintain the inside of the display panel in a vacuum condition. As the inside of the hermetic container is maintained in a vacuum of about $10^{-4}$ (Pa), a spacer 120 is disposed as an atmospheric pressure resistant structure for the purpose of preventing destruction of the hermetic container caused by atmospheric pressure or unexpected shocks. The spacer 120 is fixed by fixtures (not shown) outside an image display area.

N×M surface-conduction electron-emitter devices 112 (N and M are positive integers of 2 or more, and those integers are predetermined in accordance with the target number of display pixels) are formed in the rear plate substrate 115. The N×M surface-conduction electron-emitter devices 112 are arranged in a simple matrix (and connected) by M row wirings 113 and N column wirings 114. An intersection between the row and column wirings 113 and 114 is insulated by an insulating layer (not shown).

According to the preferred embodiment, the surface-conduction electron-emitter devices 112 are arranged in the simple matrix. However, the invention is not limited to the simple matrix arrangement, and can employ FE or MIM electron-emitter devices instead.

Figure 3:
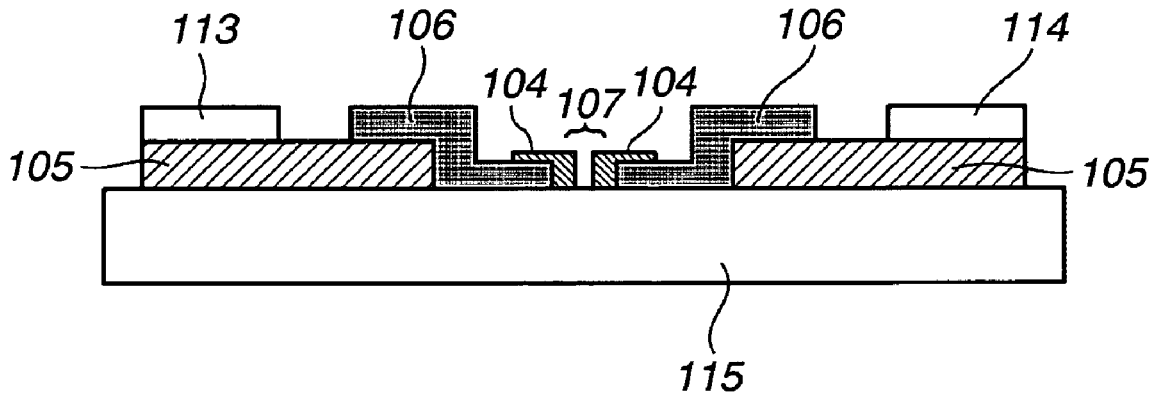
FIG. 3 is a sectional view showing an electron-emitter device used in the image forming apparatus of the embodiment of FIG. 1.

FIG. 3 is a schematic sectional view (taken across the line B-B' of FIG. 1) of a surface-conduction electron-emitter device of the illustrated embodiment. The reference numerals 115, 113 and 114 denote respectively the rear plate substrate, the row wiring and the column wiring, reference numeral 105 denotes an electrode element, reference numeral 106 denotes a conductive thin-film, reference numeral 107 denotes an electron emission portion formed by an energizing forming process or an energizing activating process, and reference numeral 104 denotes a carbon film deposited on the conductive thin-film 106 near the electron emission portion 107.

A phosphor film 118 (FIG. 1) is formed on the face plate substrate 117. As the embodiment is a color display apparatus, phosphors of three primary colors of red, green and blue used in a CRT field are separately coated on the phosphor film 118. For example, as shown in FIG. 4, the phosphors of the respective colors are separately coated in stripes, and a black conductive element 110 is disposed between the phosphor stripes.

Figure 4:
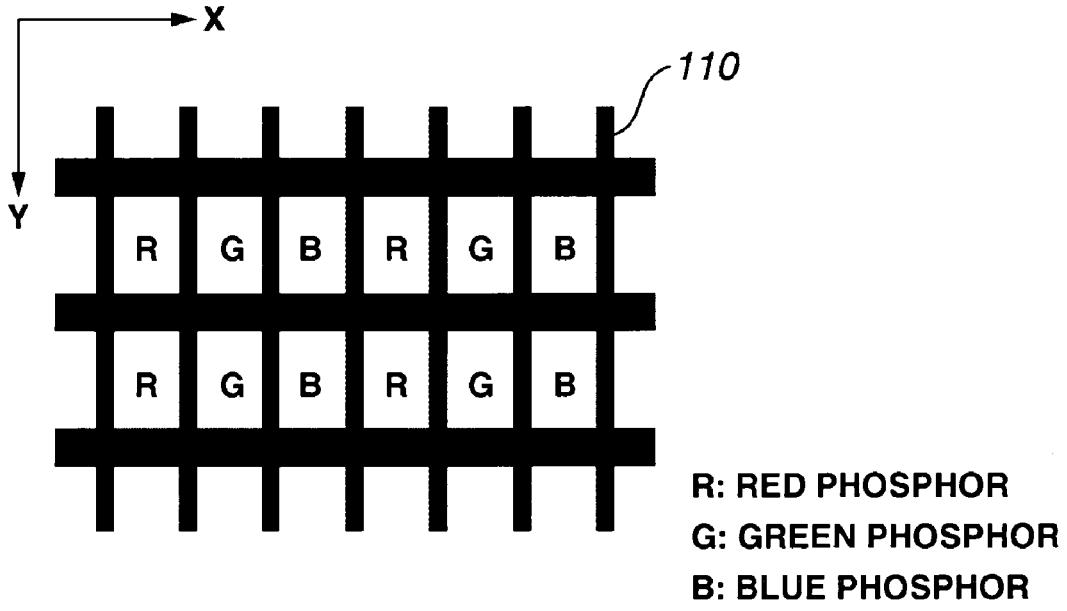
FIG. 4 is a plan view showing a phosphor arrangement of a face plate used in the image forming apparatus of the embodiment of FIG. 1.

However, the separate coating of the phosphors of the three primary colors is not limited to the stripe arrangement of FIG. 4. Other arrangements such as a delta arrangement may be employed in accordance with an arrangement of electron sources.

In a case where a monochromatic display panel is employed, only a monochromatic phosphor material needs to be used for the phosphor film 118, and a black conductive material does not necessarily need to be used.

A metal back 119 well-known in the CRT field is disposed as an anode electrode on a side of the phosphor film 118 (FIG. 1) facing the rear plate substrate 115.

The face plate substrate 117 has disposed along its inner surface an electrode 121 for supplying a potential to the anode electrode (metal back 119) via a resistor 123. For the resistor 123, refer to FIG. 5, for example (described later) The resistor 123 is effective for suppressing current and reducing discharge damage when electric discharge occurs between the metal back 119 and the rear plate 115. When a thickness of the metal back 119 is about 100 nm to 200 nm, an acceleration voltage (Va) applied to the metal back 119 is preferably about 10 kV. Under this condition a transmittance of electrons emitted from the electron-emitter and accelerated to the metal back 119 is near 1 (100%), resulting in high efficiency for its use. For this reason, when a voltage applied to the metal back 119 is set to 10 kV, an upper limit of a resistance value of the resistor 123 is preferably about 1 GΩ. Under this condition an emission current of each electron-emitter device is 1 to 10 μA, and a voltage drop through the resistor 123 is about 1 kV even in line-sequential driving in which 1000 devices are driven simultaneously, enabling good image displaying. Further, in view of a case in which the acceleration voltage Va exceeds 10 kV, an upper limit of the resistance value of the resistor 123 is preferably set to about 10 GΩ. A lower limit of the resistance value is selected so as to prevent occurrence of device destruction by a current flowing during discharge. If a current of several 100 mA flows between the electron source and the metal back 119 due to discharge during an operation at Va=10 kV, the effect of destruction becomes conspicuous. Therefore, the resistance value of the resistor 123 is specifically selected from 10 kΩ to 10 GΩ.

Furthermore, the face plate 117 includes a guard electrode 122 electrically connected to an electrode 121 via a resistor film 124. For the resistor film 124, refer to FIG. 7 and so on (described later). The guard electrode 122 is effective for preventing an increase in the potential of a peripheral portion when an anode potential is increased or the peripheral portion of the electron beam display apparatus is narrowed. In this case, the resistor film 124 is effective for preventing occurrence of creeping discharge. The guard electrode 122 has the above-described effect even when there is no electrode 121. In this case, the guard electrode 122 and the anode electrode (back metal 119) are interconnected via the resistor film 124.

Figure 2:
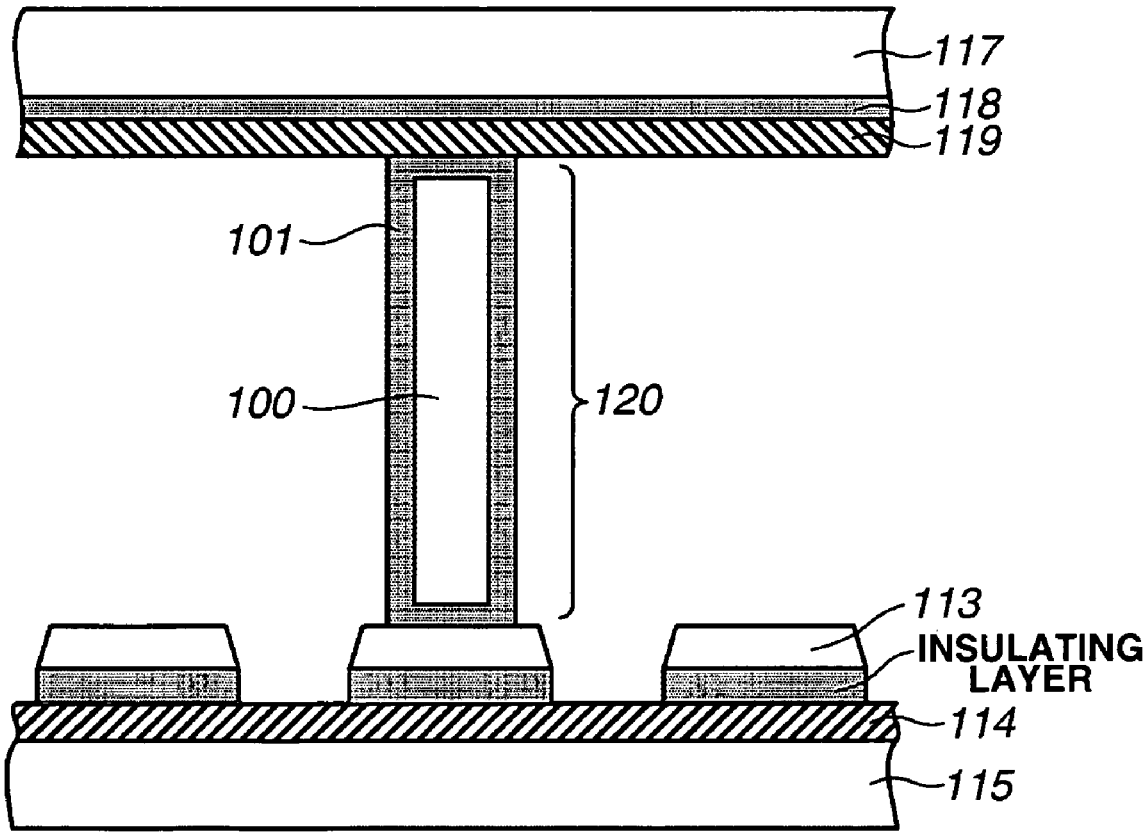
FIG. 2 is a sectional view showing a spacer structure used in the image forming apparatus of the embodiment of FIG. 1.

FIG. 2 is a schematic view taken across line A-A' of FIG. 1, each numeral corresponding to that of FIG. 1. The spacer 120 is prepared by forming a high-resistor film (first resistor film) 101 on a surface of an insulating base material 100 for the purpose of preventing charging. To achieve the purpose, the required number of spacers 120 is arranged at predetermined intervals. As the insulating base material 100 for the spacer 120, for example, quartz glass, glass in which a content of impurities such as Na is reduced, soda lime glass, a ceramics member such as alumina, or the like preferably are employed. Materials whose coefficient of thermal expansion is close to that of the hermetic container are preferred for that purpose.

According to the preferred embodiment, the spacer 120 takes the shape of a thin plate, arranged in parallel with the row wiring 113, and is electrically connected to the same.

Now, referring to FIGS. 5 and 6, configurations around the electrode 121 and the guard electrode 122 according to a preferred embodiment of this invention will be described in detail.

Figure 5:
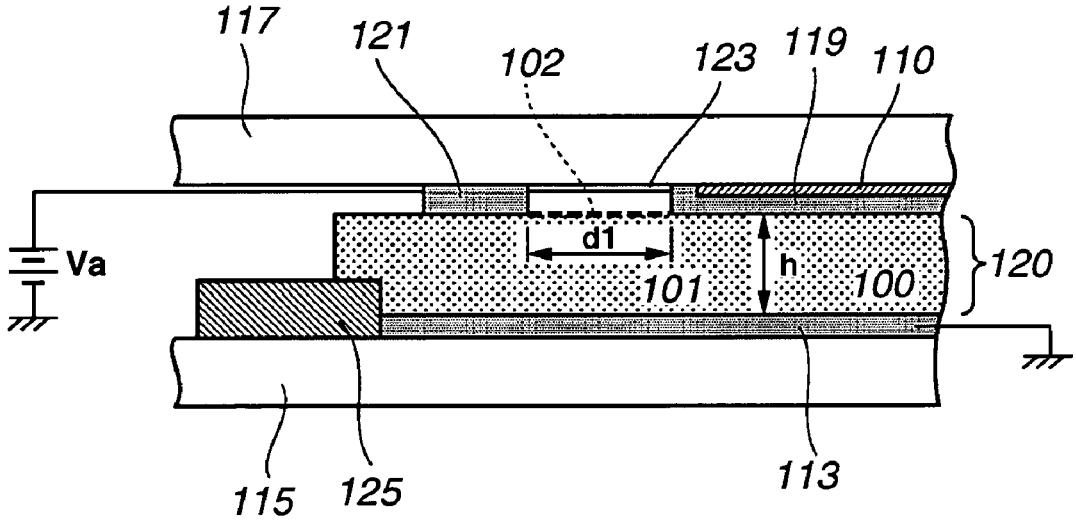
FIG. 5 is a sectional view showing a characteristic portion of the image forming apparatus of the embodiment of FIG. 1.

FIG. 5 is a schematic sectional view taken across line C-C' of FIG. 1, showing only the components that are necessary for explaining functions of the second resistor film 102.

Reference numeral 117 denotes the face plate substrate. A face plate section is formed by the substrate 117, the black conductive element 110, the metal back 119, the electrode 121, and the resistor 123, which are disposed along the inner surface of the substrate 117. The electrode 121 is connected to a high-voltage power supply (not shown) outside a vacuum container (not shown in FIG. 5), and supplies a potential to the metal back 119 via the resistor 123. The reference numeral 120 denotes the spacer which includes the high-resistor film 101 formed on the surface of the base material 100 (FIG. 2). The resistor film 102 is formed at least between a contact portion (a portion of the spacer 120 in contact) with the electrode 121 and a contact portion (a portion of the spacer 120 in contact) with the metal back 119 on a surface (an end surface) of the spacer 120 facing the face plate substrate 117. The reference numeral 115 denotes the rear plate substrate, and the spacer 120 is arranged on the row wiring 113. The spacer 120 is fixed outside an image display area by a fixing member 125. In a portion (portion d1 in FIG. 5 which is a noncontact portion, i.e., a portion of the spacer end surface not in contact with the elements 119 and 121) of the end surface of the spacer 120 between the contact portion with the electrode 121 and the contact portion with the metal back 119, a potential drops under the influence of a potential of the row wiring 113, and as a result, field intensity with the opposite resistor 123 is increased. Consequently, an electric discharge may occur depending on a length (d1 in FIG. 5) of the noncontact portion and a height (h in FIG. 5) of the spacer 120. According to the invention, the potential drop can be suppressed by setting a sheet resistance value of the resistor film 102 lower than that of the high-resistor film 101. Thereby, the electric discharge is suppressed.

A sheet resistance value of the resistor film 102 preferably is selected so as to not exceed field intensity $10^9$ V/m which is generally believed to cause electron emission. For example, Table 1 below shows required sheet resistance values for certain ratios of a length d1 of the noncontact portion (i.e., portions not contacting adjacent elements) of both the resistor 123 and the resistor film 102 to a height h of the spacer 120, for acceleration voltages Va when a distance between the resistor film 102 and the resistor 123 in the noncontact portion is 1 μm. Values in the Table 1 are ratios of sheet resistance values of the resistor film 102 to sheet resistance values of the high-resistor film 101. A distance between the resistor 123 and the spacer 120 is preferably set equal to at least 1 μm or more to surely prevent contact therebetween. The length d1 is preferably set equal to at least 2 mm, the height h of the spacer 120 is preferably set equal to 4 mm or less to thin down an image forming layer, and the acceleration voltage Va is preferably set equal to at least 10 kV to achieve high luminance. In this case, from the Table 1, the sheet resistance value of the resistor film 102 is preferably set equal to 1/10 or less of the high-resistor film 101.

TABLE 1

Ratios of Sheet resistance value of resistor film 102 to sheet resistance value of resistor film 101

| | Ratio of noncontact length d1 to height h | | | | |
|---|---|---|---|---|---|
| Va | 0.5 | 1 | 2 | 3 | 7 |
| 3 kV | — | 1/10 | 1/100 | 1/100 | 1/1000 |
| 5 kV | — | 1/10 | 1/100 | 1/100 | 1/1000 |
| 10 kV | 1/10 | 1/100 | 1/100 | 1/1000 | 1/1000 |
| 15 kV | 1/10 | 1/100 | 1/1000 | 1/1000 | 1/10000 |
| 20 kV | 1/10 | 1/100 | 1/1000 | 1/1000 | 1/10000 |

More preferably, the field intensity of the noncontact portion should not exceed $10^7$ V/m to obtain freedom to design a desired shape of the apparatuses. In this case, the sheet resistance of the resistor film 102 is preferably set equal to or less than 1/1000 of a value of the high-resistor film 101.

Additionally, the resistor film 102 needs to have a discharge current suppression function to deal with discharge in the image display area (discharge between the anode associated with the face plate 117 and the wiring (or electron-emitter device) associated with the rear plate 115). Therefore, a resistance value of the portion (noncontact portion) of the film 102 between the electrode 121 and the metal back 119 on the end surface of the spacer 120 preferably is set to be at least greater than that of the resistor 123.

Further, a resistance value of the portion (noncontact portion) of the film 102 between the contact portion of the end surface of the spacer 120 with the electrode 121 and the contact portion of the spacer 120 with the metal back 119 more preferably is equal to 100 times or greater than that of the resistor 123, because a discharge current suppression effect is obtained, which the resistor 123 originally has.

The resistor film 102 only needs to be present in the portion (noncontact portion) between the contact portion of the spacer 120 end surface with the electrode 121 and the contact portion of the spacer 120 end surface with the metal back 119, but in other embodiments it may be formed along the entire end surface of the spacer 120.

An electrode (not shown) may be disposed along the end surface of the spacer 120 to improve electrical connection between the spacer 120 and the electrode 121, or between the spacer 120 and the metal back 119. In this case, an electrode must not be formed along the spacer portion (noncontact portion) extending between the contact portion of the end surface of the spacer 120 with the electrode 121 and the contact portion of the spacer 120 end surface with the metal back 119.

Figure 6:
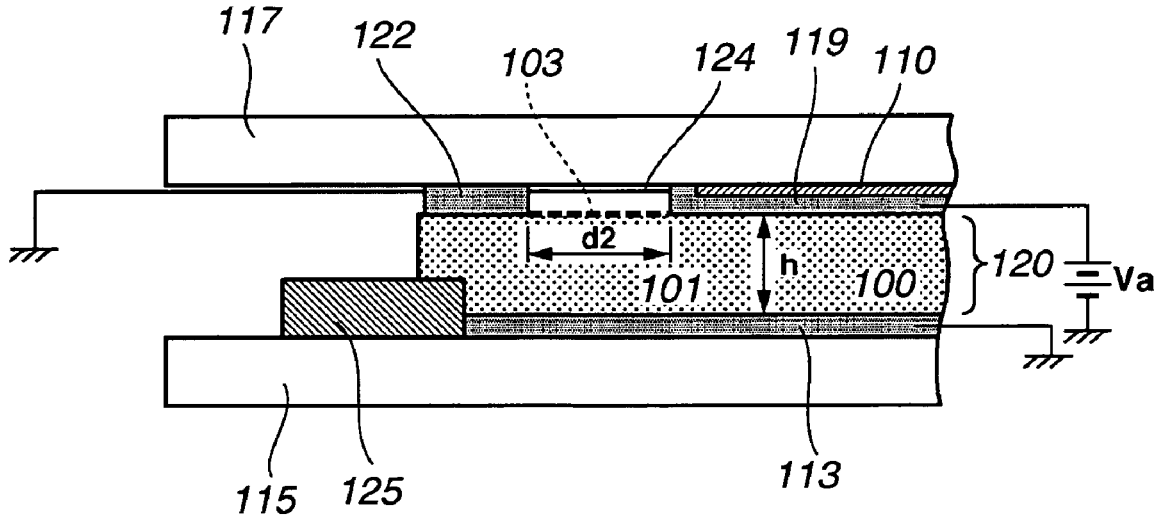
FIG. 6 is a sectional view showing another characteristic portion of the image forming apparatus of the embodiment of FIG. 1.

FIG. 6 is a schematic sectional view taken across line C-C' of FIG. 1, but showing only components necessary for explaining functions of the second resistor film 103.

The reference numeral 117 denotes the face plate substrate, wherein the black conductive element 110, the metal back 119, the guard electrode 122 and the resistor film 124 are disposed along the inner surface of the element 117. The guard electrode 122 is connected to the meal back 119 via the resistor film 124. A potential which is a ground (GND) potential or sufficiently lower than an anode potential applied to the metal back 119 is applied to the guard electrode 122, and an anode potential is applied to the metal back 119. The reference numeral 120 denotes the spacer which includes the high-resistor film 101 formed on the surface of the base material 100. The resistor film 103 is formed along a portion (second noncontact portion) of the spacer 120 at least between the guard electrode 122 and the metal back 119 on the surface of the spacer 120 facing the face plate substrate 117(end surface).

As described above, in FIG. 6, only the main components necessary for explaining the requirements and functions of the resistor film 103 are shown. Accordingly, for convenience, some components in the cross section C-C' of FIG. 1 are omitted from FIG. 6, such as, for example, the electrode 121. The reference numeral 115 is the rear plate substrate, and the spacer 120 is arranged on the row wiring 113. The spacer 120 is fixed outside the image display area, by the fixing member 125. A potential distribution in the portion (second noncontact portion) of the end surface of the spacer 120 between the guard electrode 122 and the metal back 119 is different from that of the resistor film 124 because of an influence of a potential of the row wiring 113, thereby increasing an electric field intensity of this portion (second noncontact portion). Therefore, discharge may occur depending on a length (d2 in FIG. 6) of the noncontact portion of the resistor film 124 and of the resistor film 103 and a height (h in FIG. 6) of the spacer 120. The difference in potential distribution can be suppressed by setting a sheet resistance value of the resistor film 103 lower than that of the high-resistor film 101, and thereby, discharge is suppressed.

A sheet resistance value of the resistor film 103 preferably is selected to not exceed field intensity $10^9$ V/m which is generally believed to cause electron emission. For example, Table 2 below shows sheet resistance values required of the resistor film 103 for ratios of a distance d2 between the guard electrode 122 and the metal back 119 to a height h of the spacer 120, and for certain acceleration voltages Va when a length of the noncontact portion of the film 103 is 1 μm. The ratios in the Table 2 are ratios of sheet resistance values of the resistor film 103 to sheet resistance values of the high-resistor film 101. A distance between the resistor film 124 and the spacer 120 is preferably set equal to at least 1 μm to prevent contact therebetween. To reduce the electric field concentration in the portion (second noncontact portion) of the spacer 120 between the guard electrode 122 and the anode 119, d2/h (a ratio of the distance d2 between the guard electrode 122 and the metal back 119 to the height h of the spacer 120) is preferably 1 or more. Further, assuming that an acceleration voltage Va is set equal to at least 10 kV to achieve high luminance, the sheet resistance value of the resistor film 103 is preferably set equal to 1/10 or less of the high-resistor film 101 as shown in the Table 2.

TABLE 2

Ratios of Sheet resistance value of resistor film 103 to sheet resistance value of resistor film 101

| | Ratio of noncontact length d2 to height h 120 | | | | |
|---|---|---|---|---|---|
| Va | 0.5 | 1 | 2 | 3 | 7 |
| 3 kV | — | — | 1/10 | 1/100 | 1/100 |
| 5 kV | — | 1/10 | 1/100 | 1/100 | 1/1000 |
| 10 kV | 1/10 | 1/10 | 1/100 | 1/1000 | 1/1000 |
| 15 kV | 1/10 | 1/100 | 1/100 | 1/1000 | 1/1000 |
| 20 kV | 1/10 | 1/100 | 1/100 | 1/1000 | 1/1000 |

More preferably, the field intensity of the second noncontact portion should not exceed $10^7$ V/m to obtain freedom to design a desired shape of the apparatus. In this case, the sheet resistance of the resistor film 103 is preferably set equal to 1/1000 or less of a resistance value of the high-resistor film 101.

The resistor film 103 only needs to be present at the portion (second noncontact portion) of the spacer 120 between the guard electrode 122 and the metal back 119, but in other embodiments it may be formed along the entire end surface of the spacer 120.

An electrode (not shown) may be disposed along the end surface of the spacer 120 to improve electrical connection between the spacer 120 and the guard electrode 122, or between the spacer 120 and the metal back 119. In this case, the electrode preferably is not formed along the portion (second noncontact portion) of the spacer 120 between the guard electrode 122 and the metal back 119.

Figure 7:
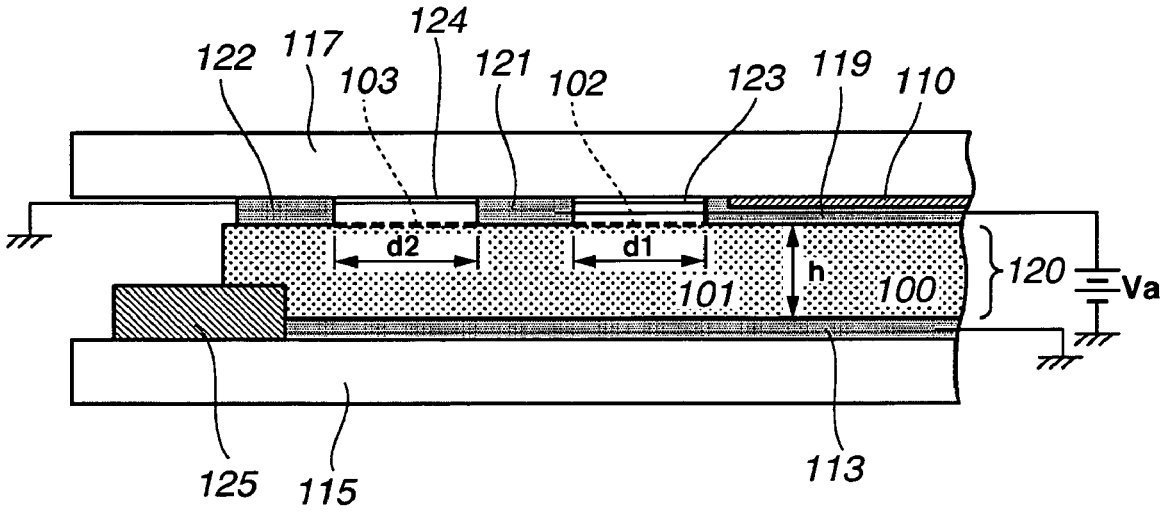
FIG. 7 is a sectional view showing yet another characteristic portion of the image forming apparatus of the embodiment of FIG. 1.

The invention also can be employed in conjunction with a face plate substrate 117, an electrode 121 and a guard electrode 122 as shown in FIG. 7. Components of FIG. 7 similar to those of FIGS. 5 and 6 have the same reference numerals. In the configuration of FIG. 7, the electrode 121 is arranged between the guard electrode 122 and an anode electrode (metal back 119), and the electrode 121 and the guard electrode 122 are preferably interconnected via a resistor film 124, whereby discharge and damage caused by discharge can both be suppressed.

Referring back to FIG. 1, Dx1 to Dxm, Dy1 to Dyn and Hv are connection terminals of hermetic structures disposed to electrically connect the display panel to external electric circuits (not shown). Terminals Dx1 to Dxm are electrically connected to the electron source row wiring 113, the terminals Dy1 to Dyn are electrically connected to the electron source column wiring 114, and the terminal Hv is electrically connected to the electrode 121 associated with the face plate substrate 117.

In the display panel described above, when a voltage is applied to each surface-conduction electron-emitter device 112 through the terminals Dx1 to Dxm or Dy1 to Dyn, electrons are emitted from the surface-conduction electron-emitter device 112. Simultaneously, a high voltage of several kilovolts is applied to the metal back 119 through the terminal Hv and the electrode 121, and the emitted electrons are accelerated to collide with an inner surface of the face plate 117. Thus, the phosphor of each color constituting the phosphor film 118 is excited to emit light, thereby displaying an image.

Normally, a voltage Vf applied to the surface-conduction electron-emitter device 112 is about 12 to 16 V, a distance d between the metal back 119 and the surface-conduction electron-emitter device 112 is about 0.1 mm to 8 mm, and a voltage Va between the metal back 119 and the surface-conduction electron-emitter device 112 is about 1 kV to 15 kV.

Hereinafter, specific examples of embodiments of the present invention will be described in detail.

EXAMPLE 1

Example 1 is an image forming apparatus for suppressing discharge and discharge current, and will be described by referring to FIG. 5.

Reference numeral 117 denotes a face plate substrate associated with a black conductive element 110, a metal back 119, an electrode 121 and a resistor 123 along its inner surface. The electrode 121 is connected to a high-voltage power supply outside a vacuum container (not shown in FIG. 5), and supplies a potential to the metal back 119 via the resistor 123. Reference numeral 120 denotes a spacer which includes a base material 100 and a high-resistor film 101 formed on a surface of the base material 100. A resistor film 102 is formed along a portion (noncontact portion) of a surface (end surface) of the spacer 120, facing the face plate 117, between where the spacer 120 contacts the electrode 121 and where it contacts the metal back 119. Reference numeral 115 denotes a rear plate substrate, and the spacer 120 is arranged on row wiring 113. The spacer 120 is fixed at a location outside an image display area, by a fixing member 125.

A height of the spacer 120 is 2 mm, a width of the end surface is 200 μm, and a distance d1 (length d1 of the noncontact portion) between the spacer's contact portion with the electrode 121 and the spacer's contact portion with the metal back 119, is 4 mm.

The metal back 119 is cut by laser every two rows of row wirings 113 in parallel with the row wirings 113, and the spacer 120 is arranged around the cut metal back stripes.

The resistor 123 was formed as a thick-film resistor by printing and burning general ruthenium oxide so that its resistance value could be 100 kΩ for each metal back stripe.

The high-resistor film 101 was formed by depositing WGeN (W: 10%, Ge: 90%, and Ar-N 2 atmosphere) with a thickness of about 100 nm by sputter deposition, and a sheet resistance value was $10^{12}$ Ω/□ (Ω/square). The resistor film 102 was formed by bundling spacers 120 to form one plane on end surfaces of a plurality of spacers 120, and depositing WGeN (W: 40%, Ge: 60%, and Ar-N 2 atmosphere) with a thickness of about 100 nm with sputter deposition masking a portion other than that where the resistor film 102 is to be formed, and a sheet resistance value was $10^{8}$ Ω/□.

In this case, a resistance of the resistor film 102 between the electrode 121 and the metal back 119 was 2 GΩ, higher than the resistor 123.

An acceleration voltage Va=10 kV was continuously applied to the image forming apparatus for 1000 hours, and no discharge occurred around the resistor 123.

To check for any damage suffered during discharge, a discharge resistance test was conducted while reducing a degree of vacuum in the image forming apparatus, but no defects occurred in the metal back 119 or the phosphor. This may be attributed to the fact that not only the resistor 123 but also the resistor film 102 function as discharge current limiting resistors.

EXAMPLE 2

Example 2 is an image forming apparatus for suppressing discharge, and will be described by referring to FIG. 6.

Reference numeral 117 denotes a face plate substrate associated with a black conductive element 110, a metal back 119, a guard electrode 122 and a resistor film 124 along its inner surface. The guard electrode 122 is connected to the metal back 119 via the resistor film 124. A potential which is a GND potential or sufficiently lower than an anode potential applied to the metal back 119 is applied to the guard electrode 122, and an anode potential is supplied to the metal back 119. Reference numeral 120 denotes a spacer which includes a high-resistor film 101 formed on a surface of a base material 100. A resistor film 103 is formed along a portion (second noncontact portion) of an end surface of the spacer 120 facing the face plate substrate 117, between where the spacer 120 contacts the guard electrode 122 and where the spacer 120 contacts the metal back 119. Reference numeral 115 denotes a rear plate substrate, and the spacer 120 is arranged on row wiring 113. The spacer 120 is fixed at a point outside an image display area, by a fixing member 125.

A height of the spacer 120 is 2 mm, a width of the end surface is 200 μm, and a distance d2 (length d2 of the second noncontact portion) between the guard electrode 122 and the metal back 119 is 4 mm.

The resistor film 124 was formed by depositing WGeN, and a sheet resistance value was $10^{12}$ Ω/□.

The high-resistor film 101 was formed by depositing WGeN, and a sheet resistance value was $10^{12}$ Ω/□. The resistor film 103 was formed by bundling spacers 120 to form one plane on end surfaces of a plurality of spacers 120, and depositing WGeN by changing a mixing ratio with W and Ge masking a portion other than that where the resistor film 103 is to be formed, and a sheet resistance value was $10^{10}$ Ω/□.

An acceleration voltage of Va=10 kV was continuously applied to the image forming apparatus for 1000 hours, and no discharge occurred around the resistor 124. This may be attributed to the fact that by setting the sheet resistance value of the resistor film 103 smaller than that of the high-resistor film 101, a potential distribution on a surface of the spacer 120 caused by the row wiring 113 is adjusted, so that a potential distribution on the resistor film 103 can correspond to that of the resistor film 124.

EXAMPLE 3

Example 3 which combines the Examples 1 and 2, is an image forming apparatus for suppressing discharge and discharge damage, and will be described by referring to FIG. 7.

A feature of the Example 3 is that a face plate substrate 117 has, associated therewith, a guard electrode 122, a resistor film 124, an electrode 121, a resistor 123, and a metal back 119 connected and arranged in this order. The guard electrode 122 is set at GND, and the electrode 121 is set at an acceleration voltage Va. A resistor film 102 is formed along a portion (first noncontact portion) of an end surface of the spacer 120 between where the spacer 120 contacts the electrode 121 and where the spacer 120 contacts the metal back 119. A resistor film 103 is formed along a portion (second noncontact portion) of the end surface of the spacer 120 between the spacer's contact portion with the guard electrode 122 and the spacer's contact portion with the electrode 121.

A height of the spacer 120 is 2 mm, and a width of the end surface is 200 μm. A distance d1 (length d1 of the first noncontact portion) between the contact portion of the spacer 120 with the electrode 121 and the contact portion with the metal back 119 is 4 mm. A distance d2 (length d2 of the second noncontact portion) between where the spacer 120 contacts the guard electrode 122 and where the spacer 120 contacts the electrode 121 is 4 mm.

The resistor 123 was formed as a thick-film resistor by printing and burning general ruthenium oxide so that its resistance value could be 100 kΩ for each metal back stripe.

The resistor film 124 was formed by depositing WGeN, and a sheet resistance value was $10^{12}$ Ω/□.

The high-resistor film 101 was formed by depositing WGeN (W: 10%, Ge: 90%, and Ar-N 2 atmosphere) with a thickness of about 100 nm by sputter deposition, and a sheet resistance value was $10^{12}$ Ω/□. The resistor films 102 and 103 were formed by bundling spacers 120 to form one plane on end surfaces of a plurality of spacers 120, and depositing WGeN (W: 20%, Ge: 80%, and Ar-N 2 atmosphere) with a thickness of about 100 nm with sputter deposition masking a portion other than where the resistor films 102 and 103 are to be formed, and a sheet resistance value was $10^{10}$ Ω/□.

In this case, a resistance of the resistor film 102 between the electrode 121 and the metal back 119 was 200 GΩ, higher than that of the resistor 123.

An acceleration voltage of Va=10 kV was continuously applied to the image forming apparatus for 1000 hours but no discharge occurred around the resistor 123 or the resistor film 124.

To check for any damage suffered during discharge, a discharge resistance test was conducted while reducing a degree of vacuum in the image forming apparatus, but no defects occurred in the metal back 119.

EXAMPLE 4

Figure 8:
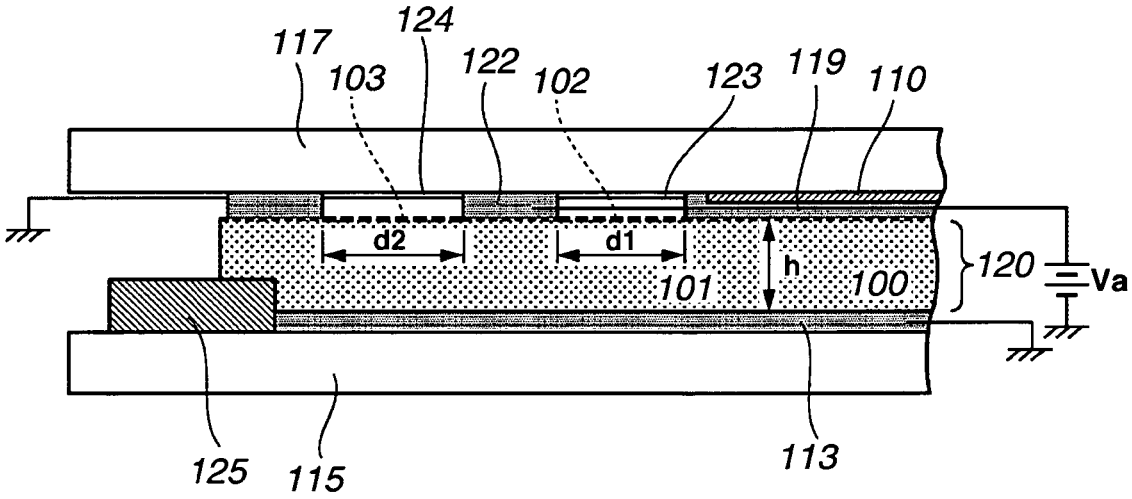
FIG. 8 is a sectional view showing an example of the image forming apparatus of the invention.

Referring to FIG. 8, Example 4 is different from the Example 3 in that resistor film 103 is formed on an entire end surface of spacer 120.

No mask was used when the resistor film 103 was formed on the entire end surface of the spacer 120. Conditions in forming the film were similar to those of Example 3.

According to the Example 4, it is not necessary to use any masks or the like during the film formation on the spacer end surface, thereby simplifying the film formation. There are also advantages such as easy alignment in assembling the image forming apparatus.

An acceleration voltage of Va=10 kV was continuously applied to the image forming apparatus for 1000 hours but no discharge occurred around resistor 123 or resistor film 124.

To check for any damage during discharge, a discharge resistance test was conducted while reducing a degree of vacuum in the image forming apparatus, but no defects occurred in metal back 119 or a phosphor.

EXAMPLE 5

Figure 9:
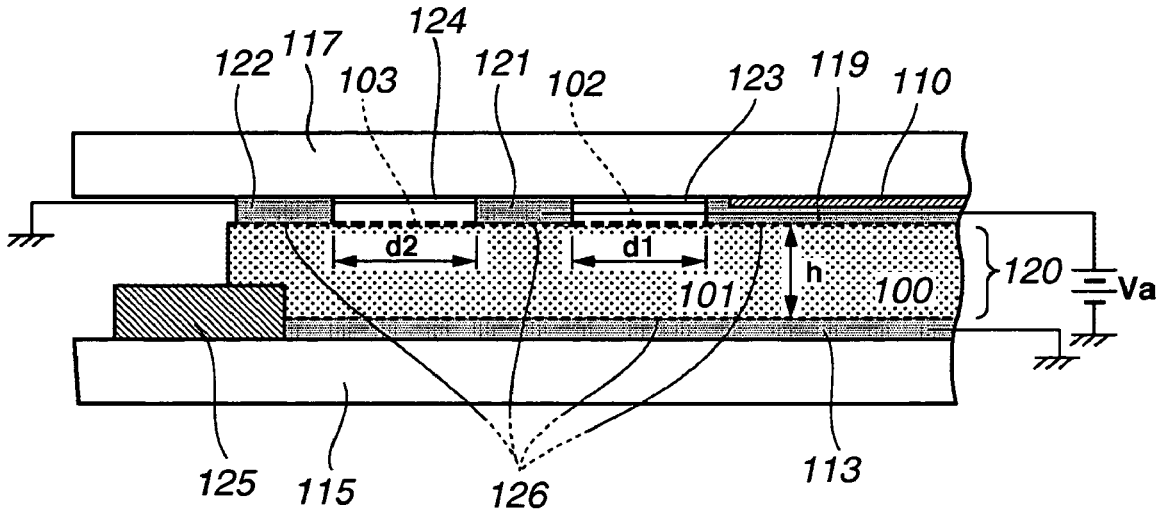
FIG. 9 is a sectional view showing another example of the image forming apparatus of the invention.

Referring to FIG. 9, Example 5 is different from the Example 3 in that metal electrodes 126 are disposed along where the end surface of spacer 120 contacts the guard electrode 122, and along where spacer 120 contacts electrode 121 and where it contacts the metal back 119. That is, metal electrodes 126 are disposed between the end surface of the spacer 120 and each of the electrode 122, the electrode 121, and the metal black 119. A metal electrode 126 is also disposed on a contact surface of the spacer 120 with a row wiring 113 (between the spacer 120 and wiring 113).

The Example 5 provides an effect of improving conduction between the spacer 120 and its contact members (guard electrode 122, electrode 121, metal back 119, and row wiring 113).

An acceleration voltage of Va=10 kV was continuously applied to the image forming apparatus for 1000 hours but no discharge occurred around resistor 123 or resistor film 124.

To check for any damage suffered during discharge, a discharge resistance test was conducted while reducing a degree of vacuum in the image forming apparatus, but no defects occurred in the metal back 119 or a phosphor.

While the present invention has been described with reference to preferred and exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-193480 filed Jun. 30, 2004, which is hereby incorporated by reference herein in its entirety, as if fully set forth herein.

What is claimed is:

1. An image forming apparatus comprising:

a first substrate having an associated potential-regulated conductive element;

a second substrate having, associated therewith, an electrode regulated at a potential higher than that of the conductive element and an anode electrode connected to the electrode via a resistor, all arranged to face the first substrate;

a spacer which abuts the conductive element, the electrode and the anode electrode to regulate a distance between the first and second substrates, wherein the spacer includes a base material, and a first resistor film which covers at least a side face of the base material and which is electrically connected to the conductive element, the electrode and the anode electrode; and a second resistor film which covers at least a portion of the spacer facing the resistor, and which is electrically connected to the electrode and the anode electrode, wherein a sheet resistance value of the second resistor film is less than a sheet resistance value of the first resistor film, and a resistance value of the second resistor film between the electrode and the anode electrode is greater than a resistance value of the resistor.

2. An image forming apparatus according to claim 1, wherein the sheet resistance value of the second resistor film is 1/10 or less of the sheet resistance value of the first resistor film.

3. An image forming apparatus according to claim 1, wherein the sheet resistance value of the second resistor film is 1/1000 or less of the sheet resistance value of the first resistor film.

4. An image forming apparatus according to claim 1, wherein a resistance value of a portion of the second resistor film facing the resistor is equal to 100 times or greater than the resistance value of the resistor.

5. An image forming apparatus according to claim 1, wherein the sheet resistance value of the first resistor film is between $10^7$ Ω/□ to $10^{14}$ Ω/□.

6. An image forming apparatus according to claim 1, wherein the sheet resistance value of the second resistor film is $10^7$ Ω/□ or more.

7. An image forming apparatus according to claim 1, wherein the resistance value of the resistor is between 10 kΩ to 10 GΩ.

8. An image forming apparatus comprising:

a first substrate having an associated potential-regulated conductive element;

a second substrate having, associated therewith, an anode electrode regulated at a potential higher than that of the conductive element, a guard electrode regulated at a potential lower than that of the anode electrode, and a resistor film electrically connected to the anode electrode and the guard electrode, all arranged to face the first substrate;

a spacer which abuts the conductive element, the anode electrode and the guard electrode to regulate a distance between the first and second substrates, wherein the spacer includes a base material, a first resistor film which covers at least a side face of the base material and which is electrically connected to the conductive element, the anode electrode and the guard electrode; and a second resistor film which covers at least a portion of the spacer facing the resistor film, and which is electrically connected to the anode electrode and the guard electrode, wherein a sheet resistance value of the second resistor film is less than a sheet resistance value of the first resistor film.

9. An image forming apparatus according to claim 8, wherein the sheet resistance value of the second resistor film is 1/10 or less of the sheet resistance value of the first resistor film.

10. An image forming apparatus according to claim 8, wherein the sheet resistance value of the second resistor film is 1/1000 or less of the sheet resistance value of the first resistor film.

11. An image forming apparatus according to claim 8, wherein the sheet resistance value of the first resistor film is between $10^7$ Ω/□ to $10^{14}$ Ω/□.

12. An image forming apparatus according to claim 8, wherein the sheet resistance value of the second resistor film is $10^7$ Ω/□ or more.

* * * * *